US006634129B1

(12) United States Patent
Freeman, Jr.

(10) Patent No.: US 6,634,129 B1
(45) Date of Patent: Oct. 21, 2003

(54) MODIFIED BOLT ASSEMBLY AND FIRING MECHANISM FOR AN MG 34 MAUSER RIFLE

(76) Inventor: Richard N. Freeman, Jr., 7646 Kniffen, Painesville, OH (US) 44077

( * ) Notice: Subject to any disclaimer, the term of this patent is extended or adjusted under 35 U.S.C. 154(b) by 0 days.

(21) Appl. No.: 09/929,871

(22) Filed: Aug. 14, 2001

Related U.S. Application Data

(60) Provisional application No. 60/226,836, filed on Aug. 22, 2000.

(51) Int. Cl.[7] ..... F41A 3/16
(52) U.S. Cl. ..... 42/69.02; 89/188
(58) Field of Search ..... 89/174, 188, 161, 89/128, 172, 185; 42/69.02

(56) References Cited

U.S. PATENT DOCUMENTS

| | | | | |
|---|---|---|---|---|
| 854,707 A | * | 5/1907 | Mason | |
| 3,010,237 A | * | 11/1961 | Colby | 42/69.02 |
| 3,236,154 A | | 2/1966 | Iwashita | |
| 3,626,805 A | | 12/1971 | Shiplee | |
| 3,924,512 A | | 12/1975 | Fagg | |
| 3,996,684 A | * | 12/1976 | Bauman et al. | 89/185 |
| 4,358,986 A | | 11/1982 | Giorgio | |
| 4,658,702 A | | 4/1987 | Tatro | |
| 4,704,945 A | | 11/1987 | Marcon et al. | |
| 4,932,309 A | | 6/1990 | Barrett | |
| 5,046,275 A | | 9/1991 | Brown | |
| 5,614,691 A | | 3/1997 | Taylor | |
| 5,663,522 A | | 9/1997 | Kuehl | |
| 5,799,434 A | | 9/1998 | Krieger et al. | |

FOREIGN PATENT DOCUMENTS

| | | | | |
|---|---|---|---|---|
| DE | 554287 | * | 7/1932 | 42/69.02 |

OTHER PUBLICATIONS

Gun List, "Catalog Advertisement, May 11, 2001," p. 174.

* cited by examiner

*Primary Examiner*—Stephen M. Johnson
(74) *Attorney, Agent, or Firm*—Hahn Loeser + Parks LLP; Stephen L. Grant

(57) ABSTRACT

The present invention is a modified bolt assembly and firing mechanism for creating a replica MG 34 Mauser rifle. The present invention provides for an MG 34 replica which fires from a closed bolt firing weapon, and is capable of only semi-automatic operation. The modified bolt assembly and firing mechanism of the present invention include design elements that deter conversion of the semi-automatic MG 34 Mauser rifle replica into a fully automatic weapon.

10 Claims, 4 Drawing Sheets

MODIFIED BOLT ASSEMBLY AND FIRING MECHANISM FOR AN MG 34 MAUSER RIFLE

This application claims priority under 35 USC 119 (e) from provisional application No. 60/226,836 filed Aug. 22, 2000, now abandoned.

FIELD OF THE INVENTION

This invention is a modified bolt assembly for an MG 34 Mauser rifle in order to provide semi-automatic operation whereby a single cartridge is fired with each pull of the trigger. More specifically, the present invention allows for the creation of a replica MG 34 Mauser rifle which fires from a closed bolt, and is capable of only semi-automatic operation, while also inhibiting conversion of the firearm to fully automatic operation.

BACKGROUND OF THE INVENTION

There has been and continues to be an interest in collecting and shooting weapons that have been developed for, and used by the military. This interest is held by many civilians, particularly those who served in the military. Because many of these firearms are capable of fully automatic operation, private ownership is limited to qualified individuals who acquire a Class II or Class III firearms dealer's license, or those individuals who apply for and obtain the requisite permission from the local authorities where they reside, and the Bureau of Alcohol, Tobacco and Firearms "ATF" to become the registered owner of a fully automatic firearm.

Semi-automatic firearms, on the other hand, are not subject to such a rigorous procedure to own and fire legally, and can currently be legally transferred between individuals. However, while there is a good selection of handguns and rifles capable of semi-automatic operation, including some "civilian" versions of military firearms, original fully automatic military firearms are not readily available in semi-automatic versions. There are numerous reasons for this, including the cost of the original firearm, the cost to convert it, the necessity for a gunsmith to perform the conversion arid, most significantly, the diminishment of value of the fully automatic firearm by converting this firearm into semi-automatic operation. Not withstanding the foregoing reasons, there is a desire for original firearms that have been legally converted to semi-automatic operation and thus more easily acquired by civilians.

SUMMARY OF THE INVENTION

The present invention is a modified bolt assembly and firing mechanism for an MG 34 Mauser rifle, which allows a firearms enthusiast to create and/or own a semi-automatic MG 34 replica which fires from a closed bolt. Modifications are made to the bolt and the firing mechanism which includes the sear arm, the disconnector and the rocker. The bolt is modified to fire when it is locked with the barrel. The bolt includes a firing pin adapter which also works to make the weapon fire only semi-automatically. In addition to modifying the bolt and the firing mechanism, minor modifications are made to the receiver of the weapon in order to receive the modified bolt and firing mechanism components. Both the disconnector and the sear arm of the firing mechanism, include design elements that prevent the weapon from being readily converted back to fully automatic operation.

BRIEF DESCRIPTION OF THE DRAWINGS

The features of the modified bolt assembly for an MG 34 Mauser rifle will become apparent to those skilled in the art from the following detailed description of the invention in light of the accompanying drawings in which.

DETAILED DESCRIPTION OF THE INVENTION

Reference will now be made in detail to the present preferred embodiments of the present invention, examples of which are illustrated in the accompanying drawings. Whenever possible, the same reference numbers will be used throughout the drawings to refer to the same or like parts.

Figure 1:
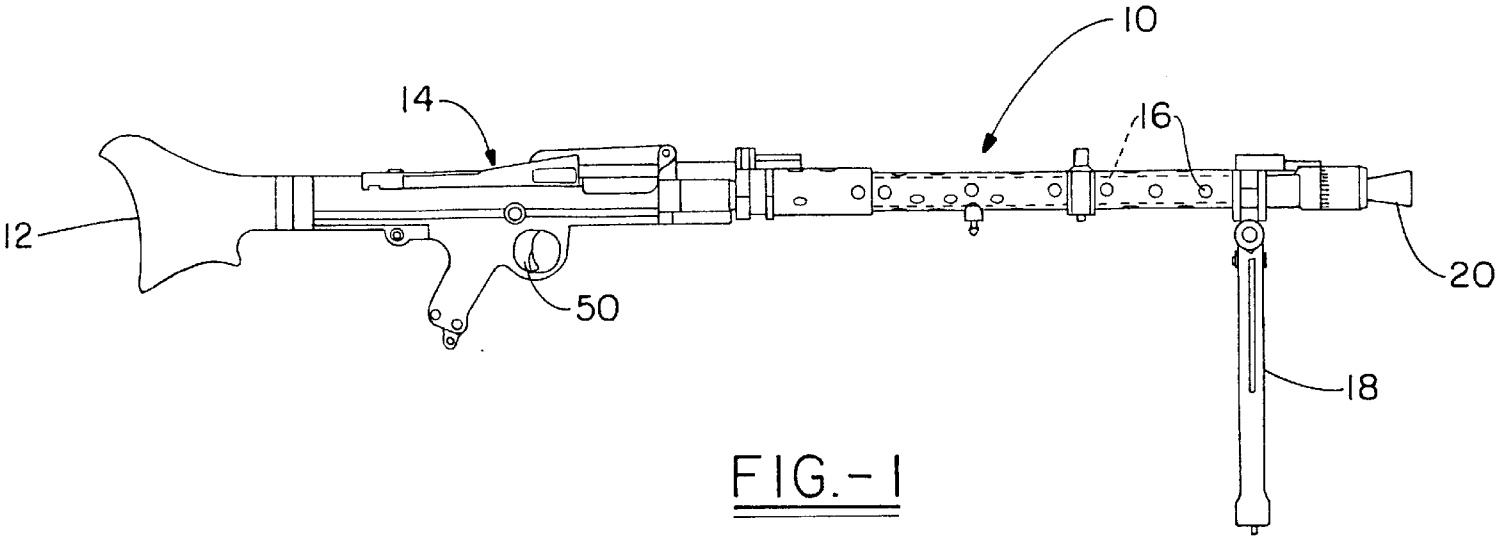
FIG. 1 is a side view of an MG 34 Mauser Rifle.
Figure 2A:
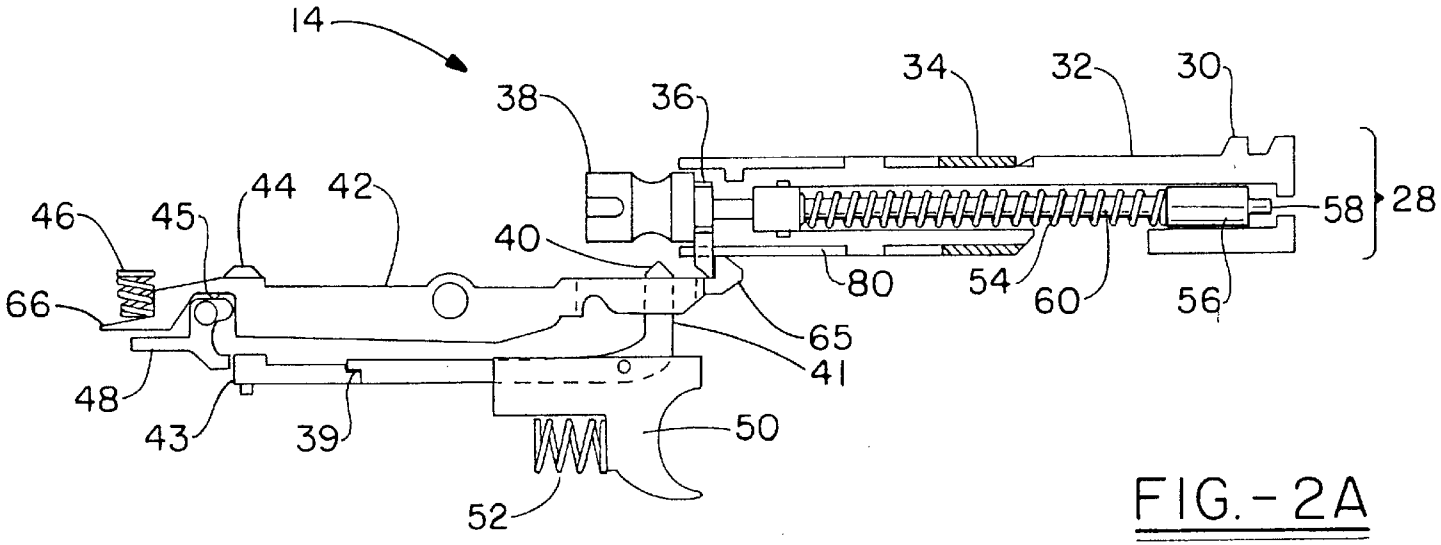
FIG. 2A is a side view of a first embodiment of the firing mechanism of the present invention.

Shown in FIG. 2A is a first embodiment of the modified firing mechanism 14 of the present design. The mechanism 14 includes a bolt assembly 28 having locking lugs 30, a bolt head 32, and a bolt housing 34. Placed within bolt housing 34 is the firing pin 56 including a face 58 for striking the primer of a cartridge (not shown), and a shaft 60. Fixed about firing pin shaft 60 is the firing pin spring 54. At the end of shaft 60 opposite firing pin face 58, is attached the cocking nut 38. A firing pin adapter 36 is affixed about firing pin shaft 60 adjacent cocking nut 38.

Firing mechanism 14 further includes a modified sear arm 42 having a positive engagement cam 44 and a sear arm spring 46. Within the pocket 45 of sear arm 42 is placed rocker 48 which is pivotally attached to the receiver (not shown) of firing mechanism 14. Adjacent to rocker 48 is disconnector 40 which is pivotally attached by a pin to the trigger 50. Adjacent trigger 50 is placed trigger spring 52.

Figure 2B:
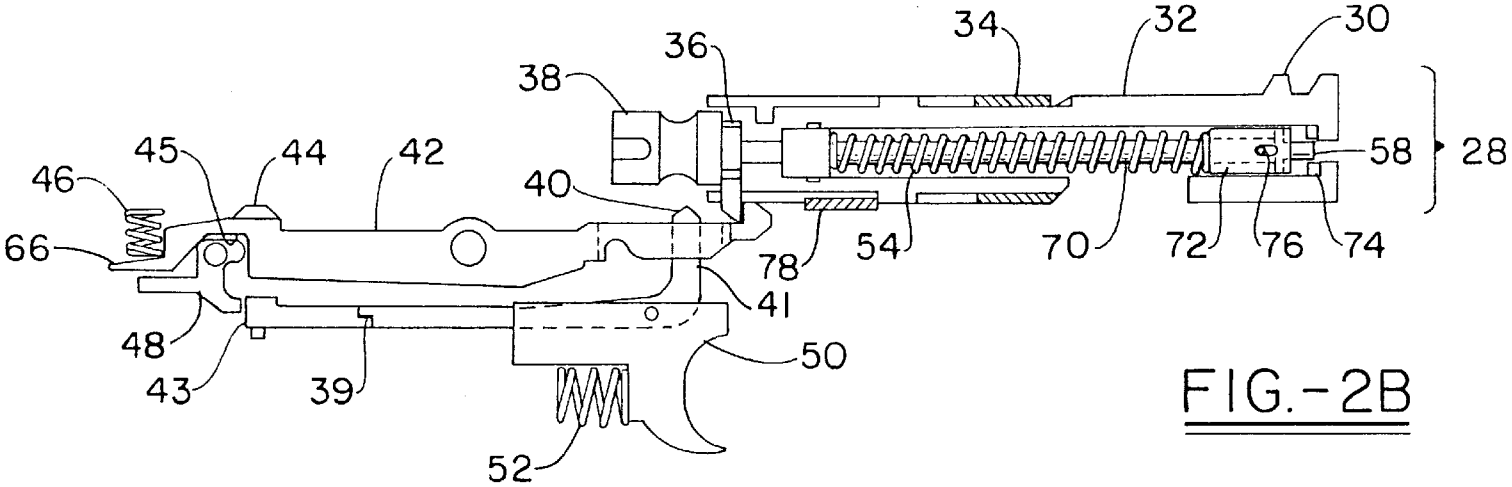
FIG. 2B is a side view of a second embodiment of the firing mechanism of the present invention.

FIG. 2B illustrates another embodiment of the proposed modification. Many of the components of this embodiment are identical to that shown in FIG. 2A with the following alternate components. This embodiment includes an inertia firing pin 70 rather than a straight mechanical firing pin, as an added safety feature. It also includes an inertia firing pin sleeve 72 which is retained by non-removable sleeve retaining pin 76. Inertia firing pin sleeve 72 acts as the firing pin spring support. A carbide bolt guide 78 is also fused into the inside of the receiver wall, with a matching groove 80 provided in the bolt assembly to prevent the use or introduction of an unmodified bolt assembly. Finally a spacer 74 is press-fit into the bolt assembly to prevent the use of a standard firing pin, as an added safety measure. The inertia firing pin assembly is also shown in FIGS. 6A through 6D.

Figure 3A:
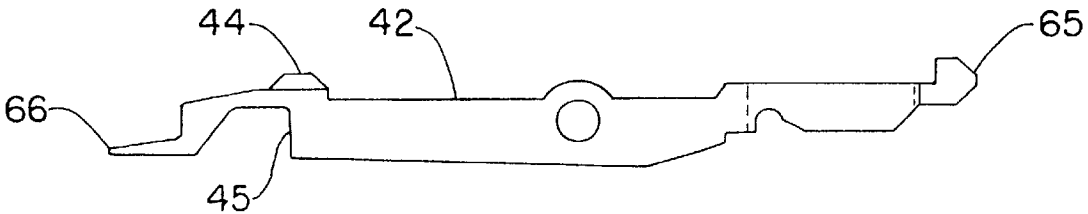
FIG. 3A is a side view of the sear arm of the firing mechanism of the present invention.
Figure 3B:
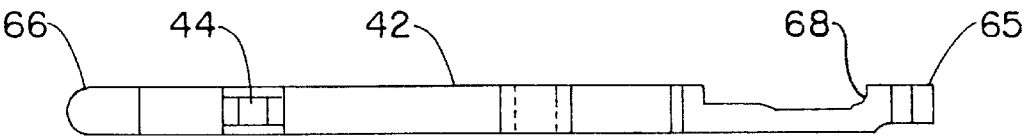
FIG. 3B is a top view of the sear arm of the firing mechanism of the present invention.
Figure 4A:
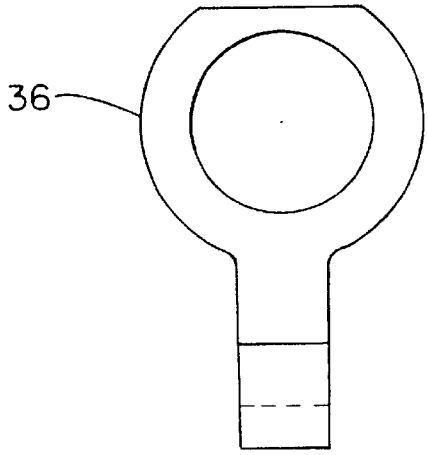
FIG. 4A is front view of the firing pin adapter of the firing mechanism of the present invention.
Figure 4B:
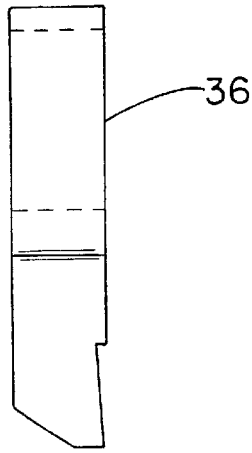
FIG. 4B is a side view of the firing pin adapter of the firing mechanism of the present invention.
Figure 5B:
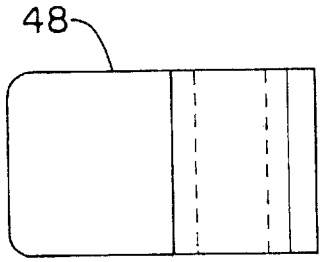
FIG. 5B is a top view of the rocker of the firing mechanism of the present invention.
Figure 5A:
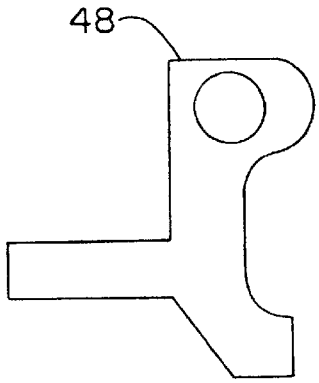
FIG. 5A is a side view of the rocker of the firing mechanism of the present invention.
Figure 5C:
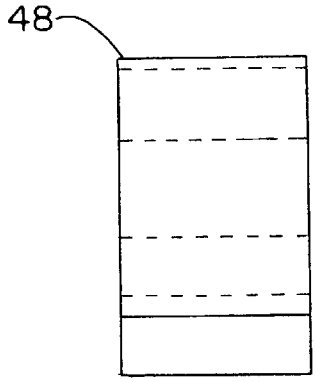
FIG. 5C is a front view of the rocker of the firing mechanism of the present invention.
Figure 6A:
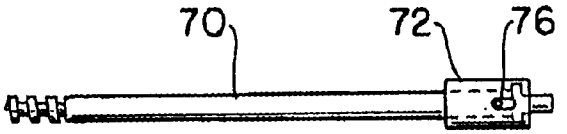
FIG. 6A is an assembled side view of the inertia firing pin assembly of the present invention.
Figure 6C:
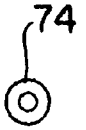
FIG. 6C is a top view of the spacer of the inertia firing pin assembly of the present invention.
Figure 6B:
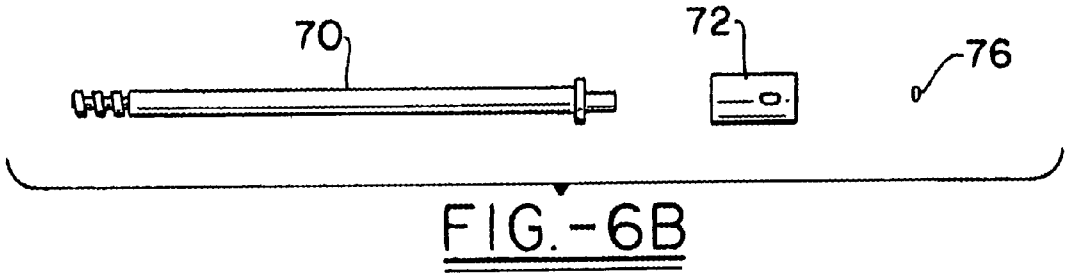
FIG. 6B is a disassembled side view of the inertia firing pin assembly of the present invention.
Figure 6D:
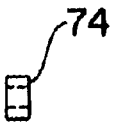
FIG. 6D is a side view of the spacer of the inertia firing pin assembly of the present invention.
Figure 7B:
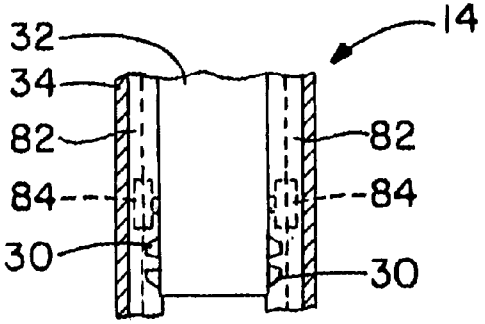
FIG. 7B is a top view of the receiver portion shown in FIG. 7A.
Figure 7A:
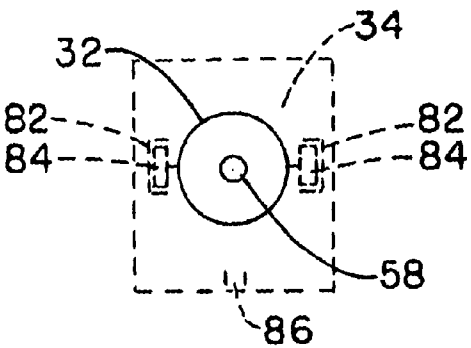
FIG. 7A is an elevational view, in section, through the receiver looking rearwardly at the front end of the bolt as it is adapted to move through the receiver toward the barrel.

Referring to FIGS. 3A and 3B, there is shown the sear arm 42 of the present invention, isolated from the firing mechanism. Front portion 65 of sear arm 42 engages with the firing pin adapter 36 (as shown in FIGS. 2A, 4A and 4B). Adjacent to front portion 65 is a detent 68. When assembled, the front portion 41 of disconnector 40 extends upwardly through pocket 68 in sear arm 42. This allows disconnector front portion 41 to engage firing pin adapter 36 upon firing of the rifle. Front portion 41 releases the firing pin shaft 60 and firing pin 56 upon the user pulling the trigger 50. This is done by front portion 41 moving downwardly and no longer engaging firing pin adapter 36.

The rear portion 66 of sear arm 42 forms a platform upon which sear arm spring 46 is placed. Above pocket 45 is a positive engagement cam 44. Positive engagement cam 44 acts to lock firing pin 60 in the cocked position after a cartridge has been discharged, in case of failure of the sear spring 46 or the presence of dirt or corrosion within the firing mechanism. This further ensures that only one round of ammunition is discharged for each depression or pull of the trigger. In doing so, positive engagement cam 44 engages the firing pin adapter 36 of the bolt 28. The positive engagement cam is an added device to ensure the return of the sear arm, in case of a spring failure or the presence of dirt within the receiver.

As can be seen in FIGS. 2A and 5A–5C, interconnecting sear arm 42 and disconnector 40 is the rocker 48. Rocker 48 is pivotally attached within the trigger mechanism of the MG 34 replica rifle. Rocker 48 fits within pocket 45 of sear arm 42. Upon depression of trigger 50, the rear portion 43 of disconnector 40 engages rocker 48, causing it to pivot and force the rear portion 66 of sear arm 42 upwardly and thus, front portion 65 downwardly. This releases the firing pin and allows firing pin face 58 to strike the primer of a cartridge (not shown), causing the cartridge to discharge.

In order to modify an MG 34 Mauser rifle to semi-automatic operation, an MG 34 rifle kit is first obtained from a gun dealer. Known dealers of these MG 34 Mauser rifle kits are Ohio Ordnance and Philadelphia Ordnance. In creating a semi-automatic MG 34 Mauser replica, the following modifications and alterations have been made to the receiver, obtainable from Philadelphia Ordnance in an unfinished state, the bolt and the firing mechanism.

Within the receiver, side grooves 82 or guides are milled out of each side of the receiver in order to cooperate with the rollers 84 on the bolt. These grooves 82 are milled to a narrower width than those in an original fully automatic MG 34 rifle. Adjacent to the grooves 82 are cams as are found in the original MG 34 Mauser rifle. Depending on the state of the receiver when purchased, the receiver may have to be bored out to allow for the original cams to be affixed to the receiver.

A narrow groove 86 is milled into the bottom of the receiver to ensure that only the modified bolt as described herein, and not the original fully automatic bolt, will fit within the receiver. This groove also prevents the full automatic trigger parts from being used and converting the MG 34 rifle back to fully automatic operation.

The bolt is modified to operate only in semi-automatic operation and to lock with the barrel during firing of the cartridge so as to fire from a closed bolt position. The roller extensions on the bolt head are shortened to engage the guides formed within the receiver to facilitate rotation of the bolt during operation. Shortening of the roller extensions on the bolt head also prevents use of the standard fully automatic MG 34 bolt assembly.

The engagement lug on the bottom of the bolt housing, on the original fully automatic bolt, is removed. A slot 80 approximately 3/16 of an inch wide, and approximately one (1) inch long is milled into the bottom rear of the bolt housing 34 to allow the firing pin adapter 36 (as shown in FIG. 2A) to pass through the bolt housing 34.

The sear assembly which includes the pin, the sear arm and the sear spring have also been removed from the bolt head and placed within the trigger mechanism of the present design. The sear cam surface of an original MG 34 bolt assembly is also removed from the bolt head.

As shown in FIG. 2A, the disconnector 40 has been re-shaped from the original MG 34 trigger disconnector. The reshaped disconnector 40 passes upward through the sear arm 42 in order to disconnect the trigger 50 when disconnector 40 is struck by the firing pin adapter 36. The disconnector 40 is comprised of two pieces, a front portion 41 and a rear portion 43. Front portion 41 selectively abuts rear portion 43 at a lap joint 39. As trigger 50 is pulled or depressed by the user, the front portion 41 of disconnector 40 moves rearwardly, as it is pinned to the trigger 50. This causes the front portion 41 to be lifted above rear portion 43. With front portion 41 no longer abutting rear portion 43, another round of ammunition cannot be discharged without resetting trigger 50 to its non-depressed position. Returning trigger 50 to its non-depressed position allows front portion 41 to abut against rear portion 43 at lap joint 39. Thus, the disconnector 40 of the present design ensures that only a single round of ammunition is fired for each pull of the trigger.

In modifying the disconnector 40, front portion 41 is milled out in order to clear the sear arm 42 of the firing mechanism. This allows for cooperation between the sear arm 42 and the disconnector 40. Additionally, the rear portion of the original disconnector of an MG 34 rifle was cleared out to allow for operation of the rocker 48.

Now referring to FIGS. 2A, 3A and 3B there is shown the sear arm of the firing mechanism of the present design. Sear arm 42 is provided with a positive engagement cam 44 which after firing of a cartridge interferes with the firing pin adapter 36, so as to prevent another cartridge from being fired without resetting the trigger 50 to its non-depressed position.

The trigger housing assembly must also be modified in order to accommodate the modified sear arm 42 and rocker 48 of the present design. A pocket is created about the back of sear arm 42 in order to allow for the required sear arm spring 46. At the front of the trigger housing assembly, a relief cut is made to allow for clearance of sear arm 42. At the rear of the trigger housing assembly, a relief cut is made to clear rocker 48.

In operation, the locking lugs 30 on the bolt 28 are locked with the cams formed on the inner surface of the barrel 16. The user pulls backward on the handle (not shown) of the bolt 28. After being pulled completely backward and released, bolt 28 slides through the receiver and a cartridge is removed from the cartridge belt and placed within the barrel 16. As the bolt 28 slides forward toward the barrel 16, the rollers on the bolt ride within the grooves formed within the front portion of the receiver, causing bolt 16 to rotate, and the locking lugs 30 to lock with the cams formed on the inner surface of the barrel 16.

During the process of loading the cartridge into the barrel, the firing pin 56 is drawn into the cocked position by engagement of the sear arm 42 and the firing pin adapter 36. The replica MG 34 semi-automatic rifle is then ready to be fired. The safety mechanism of the rifle may then be engaged or the rifle may be fired. To fire the rifle, the user depresses the trigger causing the disconnector 40 to engage the rocker 48 which engages the sear arm 42 which releases the firing pin 56 within the bolt 28. The firing pin face 58 then extends through the aperture formed in the front of bolt 28. Firing pin face 58 contacts the primer of the cartridge discharging the bullet out of the muzzle 20 of barrel 16.

Discharging the cartridge forces barrel 16 and bolt 28, which are in the locked position to move rearward toward the back of the receiver. The rollers on bolt head 32 contact the cams on the receiver causing the bolt 28 to be unlocked from the barrel 16. After unlocking with bolt 28, the barrel is forced forward into its normal position by a spring within the receiver. Bolt 28 continues rearwardly and contacts the ejector plate, which causes the discharged round to be ejected from the receiver. So long as there are cartridges remaining in the cartridge belt, bolt 28 will continue to cycle cartridges into barrel 16 for firing upon each depression or pull of the trigger. However, only one cartridge is fired for each pull of the trigger.

After being modified, the MG 34 Mauser rifle operable to fire caliber that is authentic to the rifle, the 8 millimeter Mauser cartridge. However, the MG 34 may be converted to 0.308 caliber by changing the barrel and the receiver tray that is configured for this caliber. The modified MG 34 Mauser rifle is fed cartridges via a belt. Belts of different lengths may be used to hold different numbers of cartridges. Optionally, the MG 34 may be outfitted with a canister which holds the belt, and is attached to the receiver.

Creating a World War II era MG 34 Mauser rifle which operates semi-automatically, allows for an economical means for a military firearms enthusiast to legally own and fire a firearm which was originally designed as a fully automatic firearm, without having obtain the authorization to own a fully automatic weapon.

Although the principles, preferred embodiments and preferred operation of the present invention have been described in detail herein, this is not to be construed as being limited to the particular illustrative forms disclosed. They will thus become apparent to those skilled in the art that various modifications of the preferred embodiments herein can be made without departing from the spirit or scope of the invention as defined by the appended claims.

What is claimed is:

1. A semi-automatic firearm comprising:

a bolt assembly which operates from a closed bolt comprising a bolt housing, a bolt head, locking lugs positioned on a forward end of said bolt housing, adjacent said bolt bead, an aperture formed in a face of said bolt head, a pair of rollers positioned on opposite sides of said bolt head, a firing pin positioned within said bolt housing, a firing pin string positioned about said firing pin, a firing pin adapter positioned about said firing pin and protruding out of said bolt housing, and a cocking nut affixed to said firing pin;

a receiver comprising a groove milled out of each side of said receiver for cooperation with said bolt assembly, and a groove milled into the bottom of said receiver for cooperation with said bolt assembly;

a firing mechanism comprising a trigger, a trigger spring positioned adjacent said trigger, a disconnector pivotally attached to said trigger, a sear arm which engages said bolt assembly, said sear arm having a positive engagement cam, a sear arm spring positioned upon a rearward portion of said sear arm, and a rocker positioned within a pocket formed within said sear arm;

a barrel.

2. A semi-automatic firearm as recited in claim 1, wherein said firing pin comprises an inertia firing pin, said inertia firing pin having a sleeve retaining pin for retaining an inertia firing pin sleeve about said inertia firing pin.

3. A semi-automatic rifle as recited in claim 2, wherein said firing pin adapter protrudes from said bolt housing through a slot milled through said bolt housing.

4. A semi-automatic rifle as recited in claim 3, wherein said slot is approximately 1 inch long and 3/16 of an inch wide.

5. A semi-automatic rifle as recited in claim 2, wherein said receiver further comprises a carbide bolt guide for cooperation with said bolt assembly.

6. A semi-automatic rifle as recited in claim 2, wherein said disconnector is comprised of two pieces which adjoin each other at a lap joint.

7. A semi-automatic rifle as recited in claim 1, wherein said firing pin adapter protrudes from said bolt housing through a slot milled through said bolt housing.

8. A semi-automatic rifle as recited in claim 7, wherein said slot is approximately 1 inch long and 3/16 of an inch wide.

9. A semi-automatic rifle as recited in claim 1, wherein said receiver further comprises a carbide bolt guide for cooperation with said bolt assembly.

10. A semi-automatic rifle as recited in claim 1, wherein said disconnector is comprised of two pieces which adjoin each other at a lap joint.

* * * * *